US007923084B2

(12) United States Patent
Kurachi et al.

(10) Patent No.: US 7,923,084 B2
(45) Date of Patent: Apr. 12, 2011

(54) INTERMEDIATE TRANSFER MEMBER, METHOD FOR PRODUCING THE SAME AND IMAGE FORMING METHOD

(75) Inventors: Masahiko Kurachi, Hino (JP); Hideaki Morita, Tokorozawa (JP); Hideo Yoshizawa, Fuchu (JP); Fumitaka Mochizuki, Setagaya-ku (JP)

(73) Assignee: Konica Minolta Business Technologies, Inc. (JP)

( * ) Notice: Subject to any disclaimer, the term of this patent is extended or adjusted under 35 U.S.C. 154(b) by 1121 days.

(21) Appl. No.: 11/520,889

(22) Filed: Sep. 14, 2006

(65) Prior Publication Data

US 2007/0065607 A1 Mar. 22, 2007

(30) Foreign Application Priority Data

Sep. 20, 2005 (JP) ..... 2005-271689

(51) Int. Cl.
*B41M 5/40* (2006.01)

(52) U.S. Cl. ..... 428/32.51; 428/32.12; 474/259; 474/268; 399/302; 399/308; 430/125.32

(58) Field of Classification Search ..... 428/32.51, 428/32.12; 474/259–268; 399/302, 308; 430/125.32

See application file for complete search history.

(56) References Cited

U.S. PATENT DOCUMENTS

| | | | | |
|---|---|---|---|---|
| 1,340,630 | A | 5/1920 | Maddox | |
| 1,635,638 | A | 3/1927 | Rogers | |
| 2,690,176 | A | 9/1954 | Nelson | |
| 3,260,259 | A | 7/1966 | Connelly | |
| 3,730,177 | A | 5/1973 | Thum | |
| 3,817,512 | A | 6/1974 | Torrey | |
| 4,263,901 | A | 4/1981 | Nichols | |
| 4,336,795 | A | 6/1982 | Nichols | |
| 4,367,869 | A | 1/1983 | Dailey et al. | |
| 4,543,948 | A | 10/1985 | Phillips et al. | |
| 4,576,151 | A | 3/1986 | Carmichael et al. | |
| 4,691,698 | A | 9/1987 | Bremer | |
| 5,147,286 | A | 9/1992 | Meals | |
| 5,362,305 | A | 11/1994 | Varn | |
| 5,453,075 | A | 9/1995 | Bonutti et al. | |
| 5,558,628 | A | 9/1996 | Bzoch | |
| 5,681,270 | A | 10/1997 | Klearman et al. | |
| 5,814,001 | A | 9/1998 | Schwenn et al. | |
| 6,126,624 | A | 10/2000 | Frauenberger et al. | |
| 6,173,147 | B1 * | 1/2001 | Nakashima et al. | 399/308 |
| 6,254,561 | B1 | 7/2001 | Borden | |
| 6,656,144 | B1 | 12/2003 | Coligado | |
| 2001/0023015 | A1 * | 9/2001 | Matsuo et al. | 428/195 |
| 2004/0050391 | A1 | 3/2004 | Kiwala et al. | |
| 2005/0235424 | A1 | 10/2005 | Waite | |
| 2006/0172097 | A1 * | 8/2006 | Morikoshi et al. | 428/35.7 |

FOREIGN PATENT DOCUMENTS

| | | |
|---|---|---|
| JP | 2002-365937 | 12/2002 |
| WO | WO 2005/010621 A1 * | 2/2005 |

* cited by examiner

*Primary Examiner* — Betelhem Shewareged
(74) *Attorney, Agent, or Firm* — Cantor Colburn LLP

(57) ABSTRACT

An intermediate transfer member for use in an image forming apparatus in which a toner image is formed on a photoreceptor, firstly transferred from the photoreceptor to the intermediate transfer member, and further secondly transferred from the intermediate transfer member to a recording medium, the intermediate transfer member, includes an intermediate transfer belt containing a volatile substance in a range of from 10 to 10,000 ppm as an average concentration of an entire intermediate transfer belt thereof.

25 Claims, 2 Drawing Sheets

INTERMEDIATE TRANSFER MEMBER, METHOD FOR PRODUCING THE SAME AND IMAGE FORMING METHOD

BACKGROUND OF THE INVENTION

The present invention relates to an intermediate transfer member, a producing method for the intermediate transfer member and an image forming method.

Electrophotographic image forming apparatus is recently spread into a field of printing called as convenience printing additionally to the field of copy machine and printer for office use, and is noted because it has a merit that several thousands sheets of print can be printed for a shorten time without plate making.

In one of the electrophotographic image forming methods, an image is formed by a process in which a toner image formed on a photoreceptor is primarily transferred onto an intermediate transfer member and then the transferred toner image is secondarily transferred onto a recording medium.

Such the image forming method has a merit of that many sheets of print can be made at high speed and improvement in the intermediate transfer member is continued for obtaining good transferring ability and high durability. The currently used intermediate transfer belt employs a thermoplastic resin such as polycarbonate and polyphenylene sulfide, or a resin formed in a cylindrical form by heating reaction such as polyimide and polyamideimide. In response to the recent requirements for smaller toner diameter, higher process speed and more compact machine, it has become necessary to meet increasingly stringent requirements for image quality. Among others, problems have been found in"dropout"—removal of toner from the center of letters and line drawings—and "transfer failure"—uneven density of a solid image.

For these problems in the transferring ability, for example, it is tried to provide a surface potential detecting device for detecting the potential on the back surface of the intermediate transfer member at a point being between the primary transfer position and the secondary transfer position, cf. Tokkai (Japanese Patent Application Laid-Open Publication) No. 2002-365937 for example. When a device to detect the surface potential is installed to prevent secondary transfer performances from deteriorating, however, the image forming apparatus becomes complicated and the cost increase results. This attempt according to the conventional art has failed to solve the problem related to lack of uniformity including a partial variation of the belt characteristics.

Another approach known in the conventional art is found in the belt characterized by lubricating agent coated on the surface of an intermediate transfer belt for improving release characteristics (cf. Tokkai 2005-234589). However, when the belt coated with lubricating agent is used for a long time, a crack occurs to the surface layer, the lubricating agent coated on the surface layer is separated or cleaning failure is caused by the vibration of the blade, with the result that durability is insufficient, according to this conventional approach.

SUMMARY OF THE INVENTION

The present invention provides an image process capable of maintaining a high-quality image for a long time without "dropout" as the removal of toner from the center of the letter and linear drawing or "transfer failure" as uneven density of the solid image. Another object is to provide a belt characterized by a high degree of durability wherein the belt is not damaged despite a long-time use. A further object of the present invention is to provide a method for manufacturing this belt.

The present inventors have made efforts, and have found it necessary to attain two conflicting objectives of improving the belt surface hardness in order to improve the release characteristics of the belt, and ensuring adequate flexibility in order to maintain the release characteristics for a long time. Having studied the means for achieving these objects, the present inventors have found out that stable belt transferability can be maintained when "volatile components" as plastic components and low-molecular components that evaporate upon heating is dispersed and contained in the belt. The present inventors have also found out that, when the surface layer having a high degree of surface hardness is used, a belt characterized by particularly excellent release characteristics can be obtained. In this case, however, remarkably good durability and image stability can be obtained by selecting a proper percentage for the contents of the volatile components of the substrate layer and the surface layer. This finding has led to the present invention. Here, the surface means a surface with which toner on the transfer belt is transferred, on the other hand, a surface with which toner is not transferred is defined as an inner surface.

The above theme can be attained by the following structure.

In an intermediate transfer member for use in an image forming apparatus in which a toner image is formed on a photoreceptor, firstly transferred from the photoreceptor to the intermediate transfer member, and further secondly transferred from the intermediate transfer member to a recording medium, the intermediate transfer member comprises:

an intermediate transfer belt containing a volatile substance in a range of from 10 to 10,000 ppm as an average concentration of an entire belt.

DETAILED DESCRIPTION OF THE PREFERRED EMBODIMENT

Figure 1:
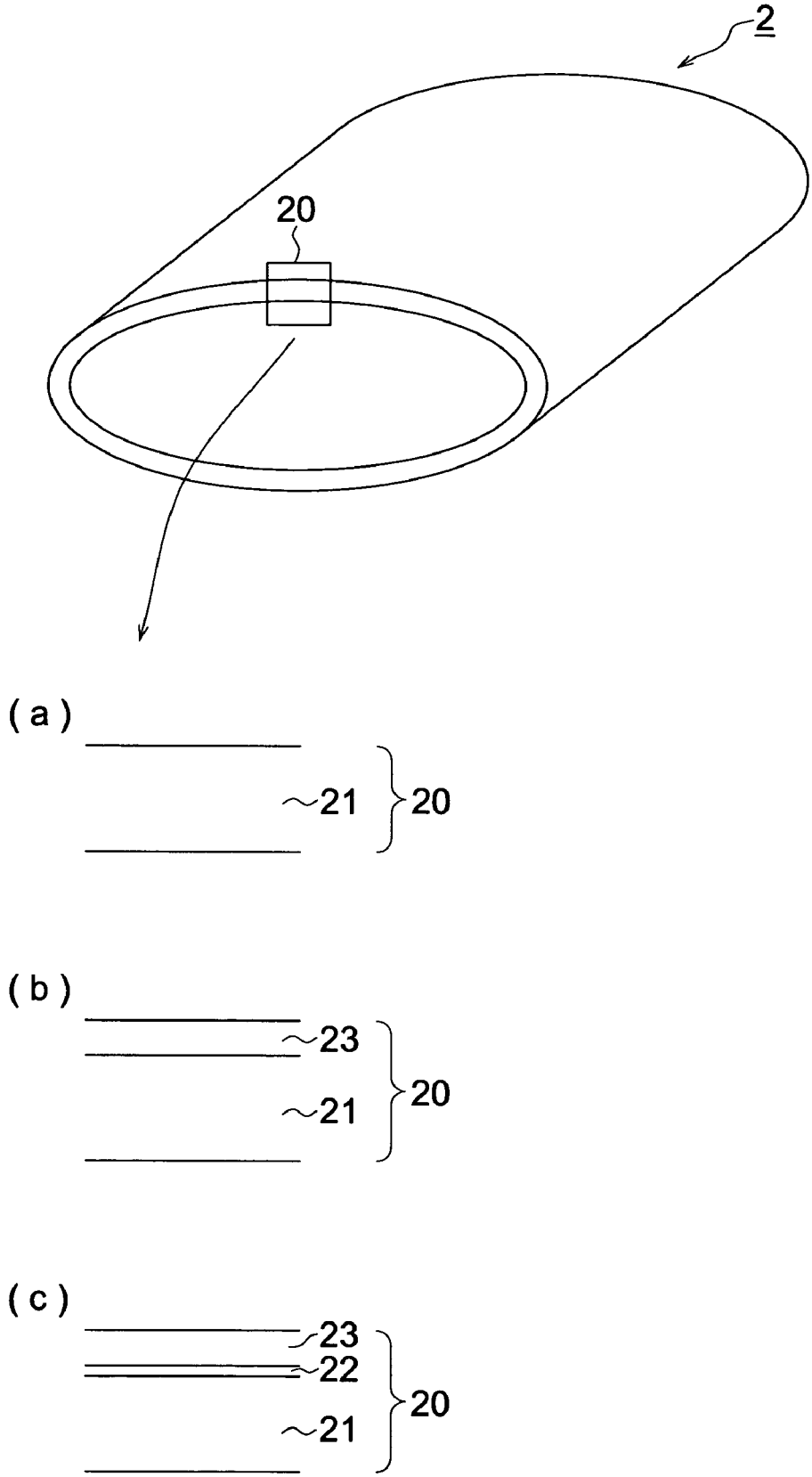
FIG. 1 is a schematic drawing showing examples of an intermediate transfer member.

The inventors investigate about the intermediate transfer member which has superior transferring ability and does not cause any crack or breakdown even when a lot of prints are made at a high speed, the producing method for the intermediate transfer member and the image forming method using the intermediate transfer member.

As a result of the investigation, it is found that an intermediate transfer member containing a specified amount of a volatile substance has good transferring ability and does not cause any crack or breakdown even when a lot of prints are made at a high speed.

It is assumed that the cracking or the breakdown of the intermediate transfer member is prevented by the action of the volatile substance as like as a plasticizer for keeping the flexibility of the intermediate transfer member.

It is further assumed that the good transferring ability can be obtained by increasing in the hardness of the intermediate transfer member only at the surface thereof by evaporating the volatile substance at the extreme surface portion of the intermediate transfer member, even though such the situation cannot be confirmed by measuring the distribution of the volatile substance in the intermediate transfer member.

The invention is described in detail below.

<<Volatile Substance in the Intermediate Transfer Member>>

The intermediate transfer member contains the volatile substance in an amount of from 10 to 10,000 ppm as an average concentration in the entire belt, preferably from 100 to 8,000 ppm, and more preferably from 500 to 6,000 ppm. By making the concentration of the volatile substance in the above range, cracks and breakage can be efficiently avoided.

For the intermediate transfer unit provided with a multi-player structure in which a surface layer is formed on a substrate layer, elongation stress is applied to the surface rather than the interior because of curvature. This requires the surface layer to contain a rather larger quantity of volatile components. Thus, surface layer preferably contains more volatile components than the interior substrate layer.

To put it more specifically, the thickness of the surface layer is preferably 1 to 8 μm and a concentration of volatile components in the surface layer is preferably 500 to 30,000 ppm in order to satisfy both of a good releasing property and a crack resisting ability. Further, the concentration C1 (wt/wt ppm) of volatile components in the surface layer and that C2 (wt/wt ppm) in the substrate layer of the intermediate transfer unit preferably has the relationship of $10 \leqq C1/C2 \leqq 500$. By making the ratio of C1/C2 to satisfy the above relationship of $10 \leqq C1/C2 \leqq 500$, a high concentration of volatile substance is maintained in the surface, whereby, although the volatile substances may evaporate slightly, cracks can be prevented from occurring for a long term. Especially, in the case that the belt is used in a machine in such a way that the belt is bended at several points by rollers and the bending direction of the belt is reversed so as to provide a high stress to the belt, to satisfy the above relationship is very effective in enhancing the crack resisting ability.

The volatile components in this case are exemplified by unreacted monomer and added oil components in addition to solvent.

The film thickness of the surface layer indicates a tendency that the thicker the film, the more easily cracks take place on the surface. Therefore, it is desirable to make the surface layer to contain volatile components in accordance with its thickness.

The relationship between the film thickness of this surface layer Hd (μm) and the concentration of the volatile components C1 (wt/wt ppm) can be expressed by:

$$100 \leqq C1/Hd \leqq 1000$$

The amount of the volatile substance in the intermediate transfer member (intermediate transfer belt) can be measured by the following head space method.

(Head Space Method)

In the head space method, the intermediate transfer member to be measured is enclosed in a tightly sealed receptacle and heated so as to fill the receptacle by the gas of the volatile substance and the gas in the receptacle is rapidly injected into a gas chromatographic apparatus for measuring the amount of the volatile substance while identifying the compound by mass spectrometry.

(Measurement Condition by Head Space Method)

Measuring Method

1. Sampling (1) A sample is cut out from a surface to an inner surface in a thickness direction from an intermediate transfer member so as to include entire layers. In a Bial bottle of 20 ml, 0.8 g of the sample is weighed. The weight of the sample is determined to accuracy of the order of 0.01 g. The Bial bottle is sealed by a septum. This is made as an entire layer sample.

(2) In the Bial bottle of (1), only a surface layer is taken from the surface layer side to an extent not to reach to a substrate layer and it is made as a sample, and then 0.8 g of the sample is sealed as the same way in (1). It is made as a surface layer sample. On the other hand, only a substrate sample is taken and it is made as a substrate layer sample.

2. Heating the Sample

The sample is put in a thermostat in a standing state and heated for 30 minutes at 170° C.

3. Setting of Condition of Gas Chromatographic Separation

The separation column is prepared by filling a carrier into a column having an interior diameter of 0.25 mm and a length of 30 m. The separation column is installed in the gas chromatographic apparatus and the gas is flowed at a speed of 50 ml/minute using helium (He) as a carrier. The temperature of the separation column is kept for 3 minutes at 40° C., raised by 200° C. in a rate of 10° C./minute, kept for 5 minutes after reaching to 200° C. and then the measurement is performed.

4. Introducing of Sample

The Bial bottle is taken out from the thermostat and 1 ml of the gas is immediately sampled and injected into the gas chromatographic apparatus by a gas-tight syringe.

5. Calculation (Determination Method of Volatile Substance)

N-hexane and n-hexadecane are preliminarily measured as standard samples for confirming the peak detecting time of each of them. After that, the measurement on the sample was performed and the areas of the total area of the peaks appearing until the peak detecting time of n-hexadecane is converted according to a toluene calibration curve to determine the total amount of the volatile substance.

The peaks each corresponding to 0.1 ppm in toluene converted value are subjected to the calculation. The mass of all the volatile substances having been measured was assumed as the same as the area-to-concentration ratio of toluene, and was converted based on this assumption. The result was considered as the mass of all the volatile substances. The following procedure was used to measure the film thickness for the surface layer, the substrate layer for the intermediate transfer unit containing the substrate and single layer: The five random positions were selected to measure the film thickness of the entire intermediate transfer unit of the substrate portion or single layer using a contact type film thickness gauge (Dial Gauge manufactured by PEACOCK Corporation), and worked out an average, which was taken up as the measured value. To measure the surface layer, a tomographic picture of the intermediate transfer unit was taken and the thickness of the surface layer was measured from the tomographic picture.

6. Constitution of Measuring Apparatus (a) Head Space Condition

Head space device: HP7694 Head Space Sampler, manufactured by Hewlett-Packard Co., Ltd.

| | | |
|---|---|---|
| Temperature condition: | Transfer line | 200° C. |
| | Loop temperature | 200° C. |

Sample amount: 0.8 g/20 ml Bial bottle (b) GC/MS condition

GC: HP5890, manufactured by Hewlett-Packard Co., Ltd.

MS: HP5971, manufactured by Hewlett-Packard Co., Ltd.

Column: HP-642 (Length: 30 m, Interior diameter: 0.25 mm), manufactured by Hewlett-Packard Co., Ltd.

Oven Temperature

Initial temperature: 40° C. (kept for 3 minutes)

Raising rate: 10° C./minute

Reached temperature: 200° C. (kept for 5 minutes)

Measuring Mode: Select Ion Monitor (SIM) Mode

<<Volatile Substance>>

Though the volatile substance in the intermediate transfer member is mainly the solvent used for preparing the coating layer of the intermediate member, a non-reacted monomer used for preparing the resin mainly constituting the intermediate transfer member and a sub-product of reaction are also contained. The concentration of volatile substances in the entire body of an intermediate transfer member or in a surface layer of an intermediate transfer member can be adjusted by changing a kind of used monomer, a kind of used solvent, or a drying condition.

As a solvent used for forming an intermediate member, a ketone type solvent, an alcohol type solvent or an aromatic type solvent may be used independently or in a mixture of them.

More concretely, as the solvent, for example, methyl ethyl ketone, methyl isobutyl ketone, iso-propyl alcohol, methyl isopropyl ketone, toluene, xylene, cyclohexane, 2-butanol and ethyl alcohol are usable.

Among them, methyl ethyl ketone, methyl isobutyl ketone and isopropyl alcohol are preferred because these solvents can maintain plasticity stably over a long period.

The non-reacted monomer includes dipentaerythrytol hexaacrylate, urethane acrylate, acrylic acid, methacrylic acid, ethyl acrylate and butyl acrylate.

The sub-product of the reaction includes dimer, trimer and oligomer of the reactive monomer.

One of the factors restricting the amount of the volatile components is reduction in releasing ability. If the volatile components contained in a intermediate transfer member exceeds 10,000 ppm, deterioration of facing as well as deterioration of transferability and dropout property may occur. The hardness of the surface preferable for transfer property is 200 $N/mm^2$ or more without exceeding 350 $N/mm^2$ in terms of universal hardness.

The following steps were used to measure the surface hardness of the intermediate transfer unit: The hardness defined in terms of universal hardness is obtained from the following equation when a indenter was pushed into an object to be measured, while a load was applied to the indenter:

$$\text{Universal hardness} = (\text{Test load})/(\text{contact surface area of the indenter with the object to be measured under test load}) \quad \text{Equation}$$

where the unit is given in MPa ($N/mm^2$). This universal hardness can be measured using a commercially available hardness measuring apparatus. For example, an ultrafine hardness meter "H-100V" (by Fischer Instrument Inc.) can be used for this measurement. In the case of this measuring apparatus, an indenter of quadrangular pyramid or triangular pyramid is pushed into the object to be measured, while a test load is applied thereto. When a predetermined depth has been reached, the surface area of the indenter in contact with the object to be measured is obtained from that depth. The universal hardness is calculated from the aforementioned equation.

Measuring Conditions

Measuring instrument: hardness indentation tester"H-100V" (Fischer Instrument Inc.)

Measuring indenter: Vickers indenter

Measuring environment: 20° C., 60% RH

Measuring sample: An intermediate transfer unit was cut to a size of 5 cm×5 cm to prepare the sample for the test.

Maximum Test Load: 2 mN

Loading conditions: Load was applied in proportion to time at a speed for reaching the maximum test load in 10 seconds Creep Time Under Load: 5 sec.

For all data items, measurement was made at 10 random positions and the average of the measurements was assumed as the hardness defined in terms of universal hardness.

<<Layer Constitution of the Intermediate Transfer Member>>

The layer constitution of the intermediate transfer member of the invention may be either a single layer constitution or a multi-layer constitution, and the multi-layer layer constitution having at least a substrate layer and a surface layer is preferable.

FIG. 1 shows a schematic drawing of an example of the intermediate transfer member of the invention.

Figure 2:
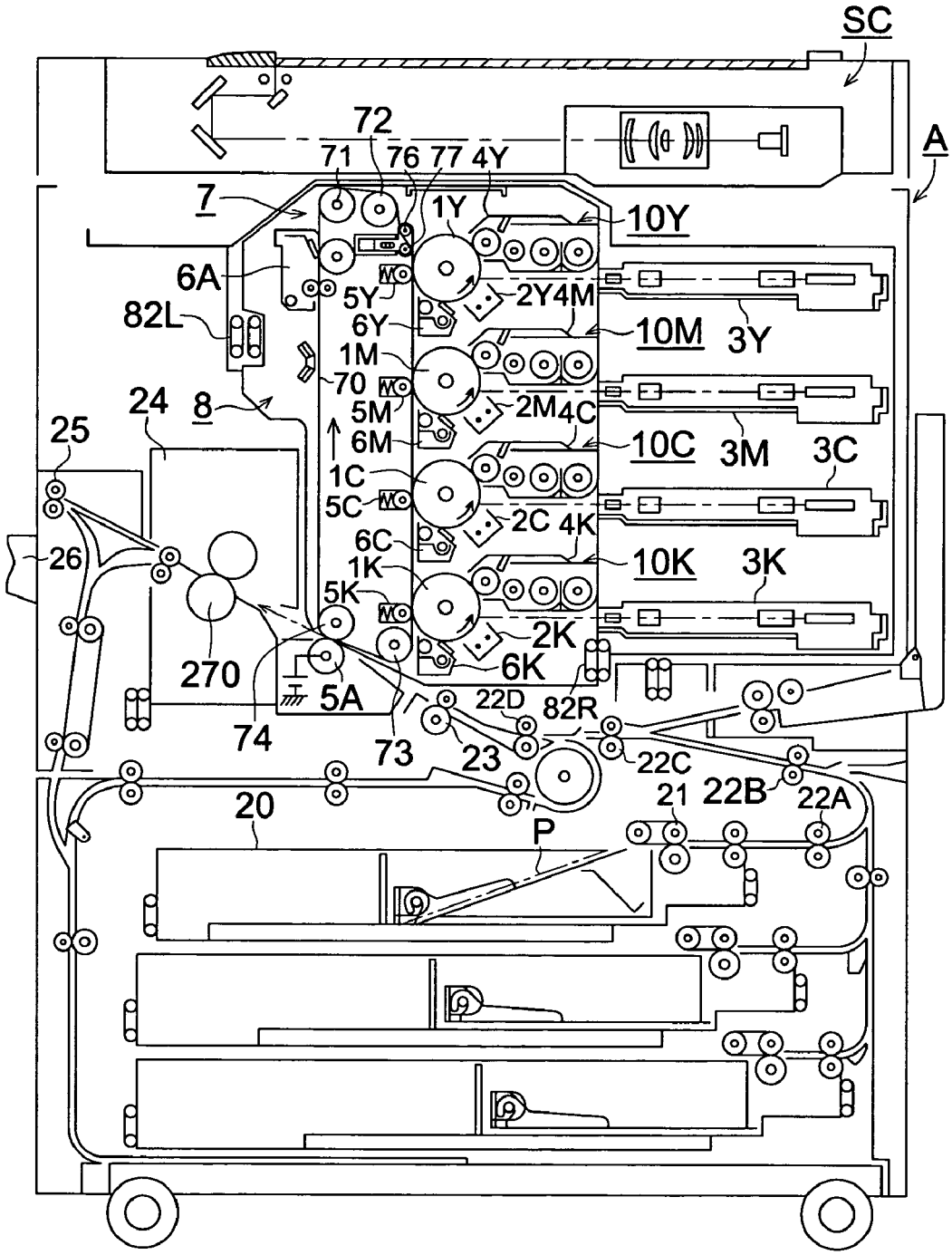
FIG. 2 is a sectional view of an image forming apparatus.

In FIGS. 1, 2 is an endless intermediate transfer member, 20 is a cross section of the intermediate transfer member, 21 is a substrate layer, 22 is an interlayer and 23 is a surface layer.

In FIG. 1(*a*) shows a single-layer intermediate transfer member, FIG. 1(*b*) shows a multi-layer intermediate transfer member having a substrate layer and a surface layer, and FIG. 1(*c*) shows a multi-layer intermediate transfer member having a substrate layer, an interlayer and a surface layer.

The substrate layer 21 is provided for stably driving the intermediate transfer member.

As the method for forming the substrate layer, a method by coating a coating liquid composed of the resin dissolved in a solvent and a method by directly forming the resin into a film state are applicable, and the later method is preferable.

The method by directly forming the resin for preparing the substrate layer includes an extrusion method and an inflation method. The resin is molten and kneaded together with an electroconductive substance to prepare a resinous material in the both cases. The resinous material is extruded and cooled for forming the substrate in the extrusion method. In the case of the inflation method, the resinous material is molten and formed into a cylinder shape mold and air is blown into the cylinder shaped resin and then the resin is cooled to form an endless belt.

The substrate can also be prepared by a centrifugal method. In such the case, a coating liquid composed of the resin dissolved in a solvent and an electroconductive substance dispersed therein is used as the material of the substrate layer.

The interlayer 22 is a layer for raising the adhesion between the substrate layer 21 and the surface layer 23, which is provided according to necessity.

For forming the interlayer, a method by coating a coating liquid prepared by dissolving a resin in a solvent and a method by directly forming by the resin are applicable and the former is preferable.

The surface layer 23 is provided for improving the transfer of the toner image from the photoreceptor to the intermediate transfer member and from the intermediate transfer layer to the recording medium.

For forming the surface layer, a method by coating a coating liquid prepared by dissolving a resin in a solvent and a method by directly forming by the resin are applicable and the former is preferable.

In the invention, it is preferable that at least one of the substrate layer, the interlayer and the surface layer is formed by coating the coating liquid prepared by dissolving the resin in the solvent.

The thickness of the intermediate transfer member is preferably from 5 to 500 μm, more preferably from 10 to 300 μm, and further preferably from 20 to 200 μm, from the viewpoint of the mechanical properties such as the strength and the flexibility even though the thickness can be optionally decided in accordance with the using purpose thereof.

There is no thickness variation caused by overlapping in the intermediate transfer member having the endless structure. Therefore, the starting position of it can be set at an optional portion of the intermediate transfer member so that a mechanism for controlling the starting point of the rotation of the intermediate transfer member can be eliminated.

<<Formation of the Intermediate Transfer Member>>

(Substrate Layer)

The substrate layer has rigidity for preventing deformation of the intermediate transfer layer caused by the load applied from a cleaning blade and increasing the influence of the deformation to the transfer portion. The substrate layer is preferably formed by a material giving a Young's modulus in the range of from 200 MPa to 5 GPa, and more preferably in the range of 300 MPa to 4 GPa. Here, Young's modulus can be measured by Hardness indentation tester "H-100V" (Fischer Instrument Inc.) mentioned above.

For the material giving such the properties, resin materials such as polycarbonate, polyphenylene sulfide, polyvinylidene fluoride, polyimide, polyether and polyether ketone are usable. These resins have a Young's modulus of not less than 200 MPa and satisfy the mechanical properties of the belt substrate at a thickness of from 100 to 150 μm.

Examples of the material usable for the substrate layer include resin materials such as polyimide, polyester, polyether, polyether ketone, polyamide, polycarbonate, polyvinylidene fluoride, fluoroethylene-ethylene copolymer and resin materials each mainly composed of the above resins. Materials prepared by blending the above resin material and an elastic material are also usable. As the elastic material, for example, polyurethane, polyisoprene chloride, NBR, chloropyrene rubber, EPDM, hydrogenated polybutadiene, butyl rubber and silicone rubber are cited. They may be used singly or in combination of two or more kind thereof.

Among them, polyphenylene sulfide or polyimide resin is preferably contained. The polyimide resin is formed by heating polyamic acid, or a precursor of the polyimide resin. The polyamic acid can be obtained by reacting an almost equal molar mixture of a tetracarboxylic acid dianhydride or its derivative and a diamine in a solution state in a polar organic solvent.

In the invention, the content of the polyimide type resin in the substrate layer is preferably not less than 51 weight % when the polyimide type resin is used in the substrate layer.

An electroconductive substance is added to the substrate layer according to necessity.

(Interlayer)

The interlayer is provided according to necessity between the substrate layer and the surface layer. Polyamide resin is usable for the interlayer. Examples of the polyamide resin include N-methoxymethylated nylons, Nylon 12 and a copolymerized nylon. The interlayer 22 is suitably provided when the adhering strength between the substrate layer 21 and the surface layer 23 is weak or the substrate layer is dissolved by the solvent of the surface layer.

For the solvent of the polyamide resin, a single solvent such as methanol and ethanol, a mixed solvent prepared by mixing water or toluene with the above single solvent, a-propanol and 2-propanol are usable. Among them, a combination of Nylon 8 and a methanol/water mixture solvent (methanol/water=3/1) is useful.

(Surface Layer)

The surface layer contains a binder resin having low surface energy so that the releasing of the toner from the belt is accelerated by lowering the surface energy. Consequently, the transferring ability of the toner image from the intermediate transfer member to the recording medium on the occasion of the secondary transfer is improved and a high quality image can be formed on the recording medium.

When the surface layer is provided on the substrate layer, it is preferable that a surface layer coating liquid containing the electroconductive substance and a reactive compound is sprayed onto the substrate layer to form a coated layer and the coated layer is dried until the fluidity of the coated layer is lost and irradiated by UV rays for curing the reactive compound, and then subjected to secondary drying for adjusting the amount of the volatile substance in the coated layer to the designated value.

As the resin of the surface layer, a resin synthesized from resin which was by thermosetting a compound having a curable functional group is preferable. The compound containing a curable functional group refers to the thermosetting compounds such as acryl, phenol, melamine, alkyd, silicone, epoxy, urethane and unsaturated polyester, or the chain polymerizable compound containing an unsaturated double bond such as vinyl ether, vinyl, styrene and acryl. One of the aforementioned compounds or a combination of two or more of them can be used.

Examples of the material of the surface layer coating liquid are listed below, but the material is not limited to them.

Dipentaerythritolhexaacrylate: Kayarad DPHA (Nihon Kayaku Co., Ltd.)

1-hydroxycyclohexylphenylketone: Irgacure 184 (Ciba Specialty Chemicals Co., Ltd.)

Antimony dope (tin oxide): T-1 (Mitsubishi Material Co., Ltd.)

Silica sol: MEK Silica-sol (Nissan Kagaku Co., Ltd.)

Polytetrafluoroethylene: KD-500AS (Kitamura Kagaku Co., Ltd.)

Polydimethyl siloxane

Methylisobutylketone:methylethylketone=8:2

The amount of the volatile substance in the intermediate transfer member is preferably controlled by the kind of the solvent used for forming the surface layer, the intensity and integral amount of UV rays, and the drying conditions.

In the invention, the integral amount of the UV rays (mJ/$cm^2$) is controlled by the intensity of the mercury lamp (mW/$cm^2$) and the irradiation time.

<Electroconductive Substance>

In the invention, the electroconductive substance is preferably added to each of the layers for controlling the potential property of the intermediate transfer member.

An electroconductive filler and an ionic electroconductive agent are usable for the electroconductive substance.

The electroconductive filler having a number average primary particle diameter of not more than 5 μm is preferable and that of from 0.01 to 1 μm is more preferable. When the average particle diameter of the electroconductive filler is not more than 5 μm, probability of maldistribution of the electroconductive filler is cancelled so that the scatter of the electric properties in the intermediate transfer member does not occur.

Concrete example of the electroconductive filler is carbon black and an electroconductive metal oxide.

Carbon black is preferably used because desired electroconductivity can be obtained by a small using amount.

As the carbon black, various known carbon blacks such as furnace black, acetylene black, thermal black and channel black, are usable.

The adding amount of the carbon black is preferably from 5 to 40 parts of the whole weight of the intermediate transfer member even though the amount may be varied in accordance with the kind of the carbon black, the amount is optionally decided so as to adjust to the required volume resistivity.

As the electroconductive metal oxide, tin oxide, zinc oxide, antimony oxide, indium oxide, potassium titanate, composite oxide of antimony and tin (ATO) and composite oxide of indium and tin (ITO) are usable.

The electroconductive metal oxide is preferably subjected to surface treatment by a silane coupling agent. The surface treatment is carried out by mixing the metal oxide with a silane coupling agent dissolved in a suitable solvent and dried by evaporating the solvent. The surface treated metal oxide, hereinafter the surface treated and non-treated metal oxide are sometimes referred to as the electroconductive agent, is raised in the compatibility with the polyimide resin so that the dispersion thereof is made uniform and the scatter of the surface resistivity is further inhibited. The adding amount of the metal oxide surface treated by the silane coupling agent is within the range of from 32 to 40 parts by weight to 100 parts by weight of the resin, although it is difficult to simply decide the amount since the amount is varied depending on the kind of the metal oxide in the same manner as in the case of the metal oxide without surface treatment. Examples of usable silane coupling agent include vinyltrichlorosilane, vinyltriethoxysilane, vinyltris (β-methoxyethoxy)-trichlorosilane, γ-chloropropyltrimethoxysilane, γ-mercapto-propyltrimethoxysilane γ-glycidoxypropyltrimethoxysilane, γ-methacryloxypropyltrimethoxysilane, γ-aminopropyl-triethoxysilane, N-(β-aminoethyl)-γ-aminopropyltrimethoxy-silane and N-(β-aminoethyl)-γ-aminopropylmethldimethoxy-silane.

The followings are usable for the ionic electric conductive agent; a cationic surfactant such as lauryltrimethylammonium, stearyltrimethylammonium, octadecyltrimethylammonium, dodecyltrimethylammonium, hexadecyltrimethylammonium, a perchlorate, chlorate, borofluorate, sulfate and ethosulfate of modified fatty acid-dimethylethylammonium salt, a quaternary ammonium salt such as a benzyl halide salt, for example, a benzyl bromide salt and a benzyl chloride salt, an anionic surfactant such as an aliphatic sulfonate, a salt of higher alcoholsulfate, a salt of an ethyleneoxide adduct of higher alcoholsulfate, a salt of higher alcoholphosphate and a salt of an ethyleneoxide adduct of higher alcoholphosphate, an amphoteric surfactant such as various betaines, a nonionic antistatic agent such as a higheralcoholethylene oxide, a fatty acid ester of polyethylene glycol and a fatty acid ester of polyvalent alcohol, a salt of metal of Group I of the periodic table such as $Li^+$, $Na^+$ and $K^+$, for example, $LiCF_3SO_3$, $NaCl_4$, $LiClO_4$, $LiAsF_6$, $LiBF_4$, NaSCN, KSCN and NaCl, an electrolyte such as $NH_4^+$, a salt of a metal of Group II of the periodic table such as $Ca^{2+}$and $Ba^{2+}$, and an antistatic agent having a group including an active hydrogen atom capable of reacting with an isocyanate such as a hydroxyl group, a carboxyl group and a primary or secondary amine group. Moreover, a complex of the above-mentioned and a poly-valent alcohol such as 1,4-butanediol, ethylene glycol, poly(ethylene glycol), propylene glycol and poly(ethylene glycol) and a derivative thereof and a complex of the above-mentioned and a mono-valent alcohol such as ethylene glycol monomethyl ether and ethylene glycol monoethyl ether are usable. One or more kinds of the foregoing ionic electroconductive substance can be employed. However, the electroconductive substance is not limited to the above-mentioned, and known ionic electroconductive resistivity controlling agents can be used.

<<Image Forming>>

<Image Forming Apparatus>

Next, an image forming apparatus used for an image forming method relating to the invention will be explained.

It is preferable that the image forming apparatus has therein a charging means, an exposure means, a developing means employing developing agents including minor diameter toner and a transfer means that transfers a toner image formed by the developing means onto a recording medium through an intermediate transfer body.

Specifically, there are given a copying machine and a laser printer, and especially preferable is an image forming apparatus capable of printing 5000 sheets or more continuously. In the apparatus of this kind, an electric field tends to be generated between an intermediate transfer body and a recording medium because a large number of prints need to be made in a short period of time. However, generation of the electric field is restrained by the intermediate transfer body of the invention, and thereby, stable secondary transfer can be carried out.

An image forming apparatus capable of using the intermediate transfer body of the invention has therein an image carrier on which an electrostatic latent image corresponding to image information is formed, a developing unit that develops the electrostatic latent image formed on the image carrier, a primary transfer means that transfers a toner image on the image carrier onto an intermediate transfer body and a secondary transfer means that transfers a toner image on the intermediate transfer body onto a recording medium such as a sheet of paper or an OHP sheet. Thus, the intermediate transfer body of the invention makes it possible to conduct stable toner image forming without generating peeling discharge in the course of the secondary transfer.

As an image forming apparatus capable of using the intermediate transfer body of the invention, there are given a monochrome image forming apparatus that conducts image forming with monochromatic toner, a color image forming apparatus that transfers toner images on an image carrier sequentially onto the intermediate transfer body and a tandem type color image forming apparatus in which a plurality of image carriers for respective colors are arranged in series.

An intermediate transfer body of the invention is effective when it is used for a tandem type color image forming.

FIG. 2 is a sectional structure diagram showing an example of an image forming apparatus capable of using an intermediate transfer body of the invention.

In FIG. 2, each of 1Y, 1M, 1C and 1K is a photoreceptor, each of 4Y, 4M, 4C and 4K is a developing means, each of 5Y, 5M, 5C and 5K is a primary transfer roller representing a primary transfer means, 5A represents a secondary transfer roller representing a secondary transfer means, each of 6Y, 6M, 6C and 6K is a cleaning means, 7 represents an intermediate transfer unit, 24 represents a heat roll type fixing unit and 70 represents an intermediate transfer body.

This image forming apparatus is called a tandem type color image forming apparatus, and it has therein plural sets of image forming sections 10Y, 10M, 10C and 10K, endless belt type intermediate transfer unit 7 representing a transfer section, endless belt type sheet feeding conveyance means 21 that conveys recording member P and heat roll type fixing unit 24. On the upper part of main body A of the image forming apparatus, there is arranged document image reading unit SC.

Image forming sections 10Y that forms an image of a yellow color as one of a toner image in a different color formed on each photoreceptor has therein drum-shaped photoreceptor 1Y representing a first image carrier, charging means 2Y arranged around the photoreceptor 1Y, exposure means 3Y, developing means 4Y, primary transfer roller 5Y as a primary transfer means and cleaning means 6Y. Image forming sections 10M that forms an image of a magenta color as one of a toner image in another different color has therein drum-shaped photoreceptor 1M representing a first image carrier, charging means 2M arranged around the photoreceptor 1M, exposure means 3M, developing means 4M, primary transfer roller 5M as a primary transfer means and cleaning means 6M. Image forming sections 10C that forms an image of a cyan color as one of a toner image in still another different color has therein drum-shaped photoreceptor 1C representing a first image carrier, charging means 2C arranged around the photoreceptor 1C, exposure means 3C, developing means 4C, primary transfer roller 5C as a primary transfer means and cleaning means 6C. Further, image forming sections 10K that forms an image of a black color as one of a toner image in still more another different color has therein drum-shaped photoreceptor 1K representing a first image carrier, charging means 2K arranged around the photoreceptor 1K, exposure means 3K, developing means 4K, primary transfer roller 5K as a primary transfer means and cleaning means 6K.

The endless belt type intermediate transfer unit 7 has endless belt type intermediate transfer body 70 representing a second image carrier in a form of an intermediate transfer endless belt which is trained about plural rollers and is supported rotatably.

Images each being in a different color formed respectively by image forming sections 10Y, 10M, 10C and 10K are transferred sequentially onto the rotating endless belt type intermediate transfer body 70 respectively by primary transfer rollers 5Y, 5M, 5C and 5K, whereby, a combined color image is formed. Recording member P such as a sheet as a recording medium loaded in sheet-feeding cassette 20 is fed by sheet-feeding conveyance means 21, to be conveyed to secondary transfer roller 5A representing a secondary transfer means through plural intermediate rollers 22A, 22B, 22C and 22D as well as registration roller 23, thus, the color image is transferred collectively onto the recording member P. The recording member P onto which the color image has been transferred is fixed by heat roll type fixing unit 24, and is interposed by sheet-ejection rollers 25 to be placed on sheet-ejection tray 26 located outside the apparatus.

On the other hand, with respect to the endless belt type intermediate transfer body 70 which has separated the recording member P therefrom through self stripping, after the color image is transferred by the second transfer roller 5A onto the recording member P, toner remaining on the endless belt type intermediate transfer body 70 is removed by cleaning means 6A.

In the course of image forming processing, the primary transfer roller 5K is constantly in pressure contact with photoreceptor 1K. Other primary transfer rollers 5Y, 5M and 5C are in pressure contact respectively with corresponding photoreceptors 1Y, 1M and 1C only in the course of color image forming.

The second transfer roller 5A comes in contact with the endless belt type intermediate transfer body 70 only when the recording member P passes through the second transfer roller 5A and the secondary transfer is carried out.

Casing 8 is arranged so that it can be drawn out of apparatus main body A through supporting rails 82L and 82R.

The casing 8 has therein image forming sections 10Y, 10M, 10C and 10K, as well as the endless belt type intermediate transfer unit 7.

The image forming sections 10Y, 10M, 10C and 10K are arranged in tandem in the vertical direction. On the left side of the photoreceptors 1Y, 1M, 1C and 1K, there is arranged endless belt type intermediate transfer unit 7. The endless belt type intermediate transfer unit 7 is trained about rollers 71, 72, 73, 74 and 76, and is composed of endless belt type intermediate transfer body 70, primary transfer rollers 5Y, 5M, 5C and 5K and of cleaning means 6A.

When the casing 8 is drawn out, image forming sections 10Y, 10M, 10C and 10K as well as the endless belt type intermediate transfer unit 7 are drawn out together solidly from the main body A.

As stated above, a toner image is formed on each of photoreceptors 1Y, 1M, 1C and 1K through charging, exposure and developing, then, toner images having respective colors are superimposed each other on the endless belt type intermediate transfer body 70, and they are transferred collectively onto recording member P, to be fixed by heat roll type fixing unit 24 through application of pressure and heating. Each of photoreceptors 1Y, 1M, 1C and 1K after the toner image thereon has been transferred onto recording member P is cleaned by cleaning means 6A to remove toner remained on the photoreceptor in the course of transfer, and then, the photoreceptors enter the aforesaid cycle of charging, exposure and developing so that succeeding image forming may be carried out.

<Recording Medium>

A recording medium used in the invention is a substrate that holds a toner image which is called an ordinary image support material, a transfer material or a transfer sheet. Specifically, there are given plain paper including thin paper up to thick paper, coated printing paper such as art paper and coated paper, Japanese paper and postcard paper which are on the market, plastic film for OHP and various types of transfer materials such as cloth or the like, to which, however, the invention is not limited.

EXAMPLES

Examples of the invention are described below, but the invention is nor limited to the examples. In the followings, the term of "part by weight" expresses part by weight to the weight of monomer or solid component unless a specific description is added.

<<Preparation of Intermediate Transfer Member>>

(Preparation of Substrate Layer)

(Preparation of Substrate Layer (1))

An electroconductive substance (carbon black particles) was added an N-methyl-2-pyrrolidone (NMP) solution of a polyamide acid composed of 3,3', 4,4'-biphenyltetracarboxylic acid dianhydide (BPDA) and p-phenylenediamine (PDA), manufactured by Ube Kosan Co., Ltd., having a solid content of 18% by weight, so that the content of the carbon black became 23 parts by weight to 100 pars by weight of the polyimide resin. The obtained composition was mixed by a collision type dispersing machine Geanus PY, manufactured by Geanus Co., Ltd., at a pressure of 200 MPa. In the machine, the mixture was divided into two streams and collided at a minimum area of 1.4 $mm^2$ and then re-divided into two streams, such the process was repeated for 5 times to prepare a polyamide acid solution containing the electroconductive substance for substrate layer.

The polyamide acid solution containing the electroconductive substance was coated in a thickness of 0.5 mm on the inner surface of a cylindrical metal mold through a dispenser and developed to form a layer uniform in the thickness by rotating the mold at 1,500 rpm for 15 minutes. Hot air of 60° C. was blown to outside of the mold for 30 minutes, and the mold was further heated at 150° C. for 60 minutes. After that the temperature was raised by 360° C. in a rate of 2° C./minute and the heating was further continued for 30 minutes at 360° C. for removing the solvent and water formed by dehydration-ring closing reaction and for completing the imide conversion reaction. The system is cooled by room temperature and the coated layer was peeled off from the mold. Thus endless belt-shaped Substrate layer 1 was obtained. The thickness of the substrate layer (1) was 100 μm and Young's modulus was 3000 (MPa).

| (Preparation of Substrate layer (2)) | |
|---|---|
| Polyphenylene sulfide resin E2180 (Toray Co., Ltd.) | 100 parts by weight |
| Carbon black: Furnace #3030B (Mitsubishi Kagaku Co., Ltd.) | 16 parts by weight |
| Polyacrylonitrilestyrene graft compound of ethylene glycidilmethacrylate copolymer: Modiper A4400 (Nihon Yushi Co., Ltd.) | 1 part by weight |
| Slipping agent: calcium montanate | 0.2 parts by weight |

The above composition was put into a single-axis extruder and molten and kneaded to prepare a resin mixture. The resin mixture was extruded into a seamless belt shape through a ring shaped die having a seamless belt-shaped extruding mouth attached at the end of the extruder. The extruded seamless belt-shaped resin mixture was cooled and solidified by putting onto a cooling drum provided at the exit of the extruder. Thus a seamless cylindrical Substrate layer 2 was obtained. The thickness of the substrate layer (2) was 105 μm and Young's modulus was 1000 (MPa).

| (Preparation of Substrate layer (3)) Substrate layer (3) was produced by following compositions with the below formulation rates. | |
|---|---|
| Polycarbonate (weight average molecular weight: 28,000, PS converted weight average molecular weight: 64,000) | 60 parts by weight |
| Polyarylate (weight average molecular weight: 30,000, PS converted weight average molecular weight: 69,000) | 26 parts by weight |
| Titanium (IV) butoxide | 0.05 parts by weight |
| 2,4- ditertiarybutylphenyl 4,4'-biphenylene diphosphonite | 0.5 parts by weight |
| Carbon black (Denka Black produced by Denki Kagaku Kogyo Co.) | 14 parts by weight |

The above compositions were put into a bi-axis extruder and melted and kneaded to make resin compositions into pellets. The pellets were extruded at a shaping temperature of 230° C. in a form of a melting tube toward a lower part of a ring-shaped die by an extruder. Then, the extruded melting tube was brought in contact with an outer surface of a cooling mandrel installed on the same axial line as that of the ring-shaped die through a supporting bar, whereby a seamless endless belt made of resin was obtained. The thickness of the belt was 120 μm and Young's modulus of the belt was 500 (MPa).

| (Preparation of Intermediate transfer member 1) (Preparation of surface layer) | |
|---|---|
| Dipentaerythritolhexaacrylate: Kayarad DPHA (Nihon Kayaku Co., Ltd.) | 100 parts by weight |
| 1-hydroxycyclohexylphenylketone: Irgacure 184 (Ciba Specialty Chemicals Co., Ltd.) | 1 part by weight |
| Antimony dope (tin oxide): T-1 (Mitsubishi Material Co., Ltd.) | 50 parts by weight |
| Silica sol: MEK Silica-sol (Nissan Kagaku Co., Ltd.) | 20 parts by weight |
| Polytetrafluoroethylene: KD-500AS (Kitamura Kagaku Co., Ltd.) | 30 parts by weight |
| Polydimethylsiloxane | 1 part by weight |
| Methyl isobutyl ketone/methyl ethyl ketone = 8/2 | 1500 pats by weight |

The above composition was mixed and dissolved for preparing a surface layer coating liquid. The coating liquid was sprayed onto the foregoing Substrate layer 1 and primarily dried at 30° C. for 30 minutes in a dryer. After that, the coated layer was cured by irradiating UV rays with an intensity of 100 mW/cm$^2$ and an integral amount of 2,000 mJ/cm$^2$ and secondarily dried at 80° C. for 60 minutes in a dryer to form a surface layer. Thus Intermediate transfer member 1 was prepared.

<Preparation of Intermediate Transfer Members 2 through 7 and 8 through 19>

Intermediate transfer members 2 through 7 and 8 through 19 were prepared by the conditions listed in Tables 1-1 and 1-2.

The substrate layers, drying and curing conditions of the surface layers and the amount of the volatile substance in each of the obtained intermediate transfer members 1 through 7 are listed in Table 1-1.

TABLE 1-1

| | | | | | Curing condition | | Volatile |
|---|---|---|---|---|---|---|---|
| *1 | Substrate layer | *2 | Primary drying condition | *3 | *4 | Secondary drying condition | substance content (ppm) |
| 1 | Substrate layer 1: PI | 100 | 50° C., 30 minutes | 200 | 5000 | 80° C., 60 minutes | 5000 |
| 2 | Substrate layer 2: PPS | 105 | 50° C., 30 minutes | 200 | 1000 | 80° C., 30 minutes | 10000 |
| 3 | Substrate layer 1: PI | 100 | 50° C., 30 minutes | 200 | 1600 | 80° C., 30 minutes | 8000 |
| 4 | Substrate layer 2: PPS | 105 | 50° C., 30 minutes | 400 | 4000 | 80° C., 60 minutes | 100 |
| 5 | Substrate layer 1: PI | 100 | 50° C., 30 minutes | 400 | 8000 | 80° C., 90 minutes | 10 |
| 6 | Substrate layer 1: PI | 100 | 50° C., 30 minutes | 100 | 800 | 80° C., 20 minutes | 11000 |

TABLE 1-1-continued

| *1 | Substrate layer | *2 | Primary drying condition | *3 | Curing condition *4 | Curing condition Secondary drying condition | Volatile substance content (ppm) |
|---|---|---|---|---|---|---|---|
| 7 | Substrate layer 1: PI | 100 | 50° C., 30 minutes | 500 | 10000 | 80° C., 120 minutes | 7 |

*1: Intermediate transfer member No.
*2: Thickness of substrate layer (μm)
*3: UV rays intensity (mW/cm$^2$)
*4: Integral light amount (mJ/cm$^2$)

The amount of solvent in the intermediate transfer ber was measured by the foregoing method.

With the manner similar to the above, volatile substance the surface layer sample and the substrate layer sample were sured. The result of the measurement is indicated in Table 1-2. Also, the measurement of the surface hardness is indicated in Table 1-2.

TABLE 1-2

| *1 | Substrate layer | *2 | *3 | Primary drying condition | Curing condition *4 | *5 | *6 | *7 | *8 | *9 | C1/Hd | C1/C2 | Surface hardness |
|---|---|---|---|---|---|---|---|---|---|---|---|---|---|
| 8 | Substrate layer 1: PI | 100 | 7 | 50° C., 30 minutes | 200 | 5000 | 85° C., 60 minutes | 3700 | 13350 | 4 | 3338 | 1907 | 322 |
| 9 | Substrate layer 1: PI | 100 | 7 | 50° C., 30 minutes | 200 | 1000 | 85° C., 30 minutes | 8900 | 33800 | 4 | 8450 | 4829 | 245 |
| 10 | Substrate layer 2: PPS | 105 | 90 | 50° C., 30 minutes | 200 | 1600 | 85° C., 30 minutes | 6350 | 19750 | 4 | 4938 | 219 | 267 |
| 11 | Substrate layer 2: PPS | 105 | 90 | 50° C., 30 minutes | 400 | 4000 | 85° C., 60 minutes | 75 | 1290 | 4 | 323 | 14 | 299 |
| 12 | Substrate layer 1: PI | 100 | 7 | 50° C., 30 minutes | 400 | 8000 | 85° C., 90 minutes | 10 | 90 | 3 | 30 | 13 | 320 |
| 13 | Substrate layer 1: PI | 100 | 7 | 50° C., 30 minutes | 100 | 800 | 75° C., 20 minutes | 11860 | 43000 | 3 | 14333 | 6143 | 220 |
| 14 | Substrate layer 1: PI | 100 | 7 | 50° C., 30 minutes | 100 | 1200 | 85° C., 120 minutes | 15 | 33 | 3 | 11 | 5 | 220 |
| 15 | Substrate layer 1: PI | 100 | 7 | 50° C., 30 minutes | 500 | 5000 | 85° C., 150 minutes | 9 | 37 | 4 | 9 | 5 | 330 |
| 16 | Substrate layer 3: PC | 100 | 150 | 50 'C, 30 minutes | 200 | 1600 | 85° C., 30 minutes | 7350 | 20750 | 4 | 5188 | 138 | 267 |
| 17 | Substrate layer 3: PC | 100 | 150 | 50° C., 30 minutes | 400 | 4000 | 85° C., 60 minutes | 125 | 508 | 4 | 127 | 3.4 | 299 |
| 18 | Substrate layer 1: PI | 100 | 7 | 50° C., 30 minutes | 200 | 1200 | 75° C., 20 minutes | 9860 | 35600 | 3 | 11867 | 5086 | 178 |
| 19 | Substrate layer 1: PI | 100 | 90 | 50° C., 30 minutes | 400 | 3000 | 85° C., 60 minutes | 500 | 11070 | 7 | 1581 | 123 | 302 |

*1: Intermediate transfer member No.
*2: Thickness of substrate layer (μm)
*3: Volatile substance content C2 (ppm) in substrate layer
*4: UV rays intensity (mW/cm$^2$)
*5: Integral light amount (mJ/cm$^2$)
*6: Secondary drying condition
*7: Volatile substance content (ppm) in whole layers
*8: Volatile substance content C1 (ppm) in surface layer
*9: Thickness of surface layer <<Evaluation on Transferring Ability>>

The above-prepared Intermediate transfer members 1 through 7 and 8 through 18 were each installed in 8050, manufactured by Konica-Minolta Business Technologies Co., Ltd., and the transferring abilities of them were evaluated.

A double-component developer composed of a toner having a median particle diameter based on number ($D_{50}$) of 4.5 μm and a coated carrier of 60 μm was used for image formation.

The printing test was carried out under a low temperature-low humidity condition (10° C., 25% RH) and a high temperature-high humidity condition (30° C., 85% RH).

The recording medium was A4 size high quality paper (64 g/m$^2$.

Copies of an A4 size original image including character image (3 and 5-point characters) having a pixel ratio of 7%, a color portrait (a dot image containing half tone), a solid white image and a solid black image, each of which occupied quarter area of the original image, were printed.

The image was printed on both sides of the recording paper and the printed image was evaluated regarding the following items. The evaluated results were classified into Ranks A, B and C. The results ranked to Ranks A and B were acceptable for practical use and those ranked to Rank C were unacceptable because a problem caused in practical use.

<Transferring Ratio>

The transferring ratio was evaluated according to the density of the image transferred and fixed on the recording medium from the photoreceptor through the intermediate transfer member.

In concrete, 10,000 sheets of duplex printing were carried out under the high temperature-high humidity condition and the density of the solid black image formed on the backside (the second face) of the 10,000$^{th}$ print was evaluated.

Evaluation Norms

A: The density of solid image was not less than 1.4; the transferring ratio was good and no problem was posed.

B: The density of solid image was not less than 1.3; no problem was posed at this level even though the transferring ratio is lowered a little.

C: The density of solid image was less than 1.3; the transferring ratio was poor, and some problems were posed in the practical use.

<Toner Scattering Around Character Image>

Ten thousands sheets of duplex printing were carried out under the low temperature-low humidity condition and the character images formed on the backside of the 10,000$^{th}$ print were visually observed through a loupe having a magnitude of 10 times for evaluating the situation of the scattered toner around the character images.

Evaluation Norms

A: Toner scattering around the character image is little; good.

B: Toner scattering around the character image was observed a little; no problem was posed in the practical use at this level.

C: Many toner scattered around the character image was observed; some problems were posed in the practical use at this level.

<<Evaluation of Durability>>

The evaluation of the durability was carried out by using the 8050 machine which was modified so that the devices for developing, transferring and cleaning were not directly touched with the intermediate transfer member.

In concrete, each of the intermediate transfer member was installed in the machine and continuous rotated under the high temperature-high humidity condition (30° C., 85% RH).

Situation of occurrence of cracks on the intermediate transfer member was visually observed at every 50,000$^{th}$ evolution.

Results of the evaluation are listed in Table 2.

TABLE 2-1

| | | Transferring ability | | | |
|---|---|---|---|---|---|
| | *1 | *2 | *3 | | Durability |
| Example 1 | 1 | A | A | A | No problem was posed until 200,000 revolutions. |
| Example 2 | 2 | B | B | A | No problem was posed until 200,000 revolutions. |
| Example 3 | 3 | A | A | A | No problem was posed until 200,000 revolutions. |
| Example 4 | 4 | A | A | A | No problem was posed until 200,000 revolutions. |
| Example 5 | 5 | A | A | B | Slight cracks occurred at 200,000 revolutions. |
| Comparative example 1 | 6 | D | D | B | Slight cracks occurred at 200,000 revolutions. |
| Comparative example 2 | 7 | D | D | D | Cracks occurred at 50,000 revolutions. |
| Example 6 | 8 | A | A | A | No problem was posed until 200,000 revolutions. |

TABLE 2-1-continued

| | | Transferring ability | | | |
|---|---|---|---|---|---|
| | *1 | *2 | *3 | | Durability |
| Example 7 | 9 | B | B | A | No problem was posed until 200,000 revolutions. |
| Example 8 | 10 | A | A | A | No problem was posed until 200,000 revolutions. |
| Example 9 | 11 | A | A | A | No problem was posed until 200,000 revolutions. |
| Example 10 | 12 | A | A | C | Slight cracks occurred at 150,000 revolutions, but no problem in image was posed until 200,000 revolutions. |
| Example 11 | 14 | A | A | B | Slight cracks occurred at 200,000 revolutions. |
| Example 12 | 16 | B | B | B | Belt dimension extended by 1% after 200,000 revolutions, but no problem in image was posed until 200,000 revolutions. |
| Example 13 | 17 | A | A | C | Slight cracks occurred at 150,000 revolutions, but no problem in image was posed until 200,000 revolutions. |
| Example 14 | 18 | B | B | C | Surface layer slightly peeled off from end portion at 150,000 revolutions, then the peeling did not progress and no problem in image was posed. |
| Example 15 | 19 | A | A | A | No problem was posed until 200,000 revolutions. |
| Comparative example 3 | 13 | D | D | D | Streaks due to scratch occurred on the belt at 100,000 revolutions. |
| Comparative example 4 | 15 | A | A | D | Cracks occurred at 50,000 revolutions, and streaks occurred on an image at 100,000 revolutions. |

*1: Intermediate transfer member No.
*2: Transferring rate
*3: Toner scattering around character image As is shown in Table 2-1, Intermediate transfer members 1 through 5 according to the invention give good results regarding all items of the transferring rate, toner scattering around character image and durability. Contrary to that, Intermediate transfer members 6 and 7 of comparative examples causes problems regarding any evaluation items and clearly different from the intermediate transfer members of the invention.

As is shown in Table 2-2, Intermediate transfer members 8 through 12, 14, and 16 through 19 according to the invention provided good transfer ability, however, comparative example of intermediate transfer members 13 and 15 caused some problem in the transfer ability. Further, if the content of a volatile component in a surface layer and in a substrate layer is kept within a proper range, the occurrence of cracks for a long term use may be suppressed and a long life belt may be obtained.

What is claimed is:

1. An intermediate transfer member for use in an image forming apparatus in which a toner image is formed on a photoreceptor, firstly transferred from the photoreceptor to the intermediate transfer member, and further secondly transferred from the intermediate transfer member to a recording medium, the intermediate transfer member, comprising:

an intermediate transfer belt containing a volatile substance in a range of from 10 to 10,000 ppm as an average concentration of an entire belt;

wherein the intermediate transfer belt comprises a substrate layer and a surface layer formed on or over the substrate layer and the surface layer includes a resin containing a curable functional group; wherein when the concentration of the volatile substance in the surface layer is C1 (wt/wt ppm) and the concentration of the volatile substance in the substrate layer is C2 (wt/wt ppm), the surface layer satisfies the following formula:

$$10 \leqq C1/C \leqq 500;$$

and wherein the surface layer is cured so that the intermediate transfer belt has a hardness of 200 to 350 N/mm$^2$ as Universal hardness.

2. The intermediate transfer member of claim 1, wherein the thickness of the surface layer is in a range of 1 to 8 μm, and the concentration of the volatile substance in the surface layer is in a range of 500 ppm to 30000 ppm.

3. The intermediate transfer member of claim 2, wherein the intermediate transfer belt includes the volatile substance in a range of from 500 to 6,000 ppm, wherein a concentration of the volatile substance in the surface layer is larger than that in the substrate layer, wherein when the thickness of the surface layer is Hd (μm) and the concentration of the volatile substance in the surface layer is C1 (wt/wt ppm), the surface layer satisfies the following formula:

$$100 \leqq C1/Hd \leqq 1000,$$

wherein the volatile substance includes at least one of a ketone type solvent, an alcohol type solvent and an aromatic type solvent, and wherein the surface layer comprises a resin obtained by thermosetting a compound having a curable functional group.

4. The intermediate transfer member of claim 1, wherein when the thickness of the surface layer is Hd (μm) and the concentration of the volatile substance in the surface layer is C1 (wt/wt ppm), the surface layer satisfies the following formula:

$$100 \leqq C1/Hd \leqq 1000.$$

5. The intermediate transfer member of claim 4, wherein the concentration of the volatile substance in the surface layer is larger than that in the substrate layer.

6. The intermediate transfer member of claim 1, wherein the volatile substance includes at least one of a ketone type solvent, an alcohol type solvent and an aromatic type solvent.

7. The intermediate transfer member of claim 1, wherein the surface layer comprises a resin obtained by thermosetting a compound having a curable functional group.

8. The intermediate transfer member of claim 7, wherein the compound having a curable functional group comprises one of a heat curable compound and a chained polymerizable compound having an unsaturated double bond.

9. The intermediate transfer member of claim 1, wherein the substrate layer comprises a resin having a Young's modulus of 200 MPa to 5 Gpa.

10. The intermediate transfer member of claim 1, wherein the intermediate transfer belt includes the volatile substance in a range of from 500 to 6,000 ppm.

11. The intermediate transfer member of claim 1, wherein the intermediate transfer belt includes an electro conductive material.

12. The intermediate transfer member of claim 1, wherein the substrate layer comprises a polyimide resin in an amount of 51 percent by weight of the substrate layer or more.

13. A method of producing the intermediate transfer belt described in claim 1, comprising steps of:

irradiating ultraviolet rays to the intermediate transfer belt, and drying the intermediate transfer belt.

14. An image forming method, comprising:

forming a toner image on a photoreceptor;

firstly transferring the toner image from the photoreceptor to the intermediate transfer belt described in claim 1; and secondly transferring the toner image from the intermediate transfer belt to a transfer medium.

15. The intermediate transfer member of claim 1, wherein the resin is a light curable resin.

16. An intermediate transfer member for use in an image forming apparatus in which a toner image is formed on a photoreceptor, firstly transferred from the photoreceptor to the intermediate transfer member, and further secondly transferred from the intermediate transfer member to a recording medium, the intermediate transfer member, comprising:

an intermediate transfer belt containing a volatile substance in a range of from 10 to 10,000 ppm as an average concentration of an entire belt, wherein the volatile substance includes at least one of a ketone type solvent, an alcohol type solvent and an aromatic type solvent.

17. The intermediate transfer member of claim 16, wherein the intermediate transfer belt has a substrate layer and a surface layer formed on or over the substrate layer.

18. The intermediate transfer member of claim 17, wherein the thickness of the surface layer is in a range of 1 to 8 μm, and the concentration of the volatile substance in the surface layer is in a range of 500 ppm to 30000 ppm.

19. The intermediate transfer member of claim 17, wherein the surface layer comprises a resin obtained by thermosetting a compound having a curable functional group.

20. The intermediate transfer member of claim 19, wherein the compound having a curable functional group comprises one of a heat curable compound and a chained polymerizable compound having an unsaturated double bond.

21. The intermediate transfer member of claim 17, wherein the intermediate transfer belt has a hardness of 200 to 350 N/mm$^2$ as Universal hardness.

22. The intermediate transfer member of claim 17, wherein the substrate layer comprises a resin having a Young's modulus of 200 MPa to 5 Gpa.

23. The intermediate transfer member of claim 16, wherein the intermediate transfer belt includes the volatile substance in a range of from 500 to 6,000 ppm.

24. The intermediate transfer member of claim 16, wherein the intermediate transfer belt includes an electro conductive material.

25. The intermediate transfer member of claim 20, wherein the substrate layer comprises a polyimide resin in an amount of 51 percent by weight of the substrate layer or more.

* * * * *